US010334912B2

(12) United States Patent
Byrd et al.

(10) Patent No.: US 10,334,912 B2
(45) **Date of Patent: *Jul. 2, 2019**

(54) MULTIFUNCTION KEY FOB

(71) Applicants: Desmond Byrd, Rockville, MD (US); Brian Byrd, Russellville, AR (US)

(72) Inventors: Desmond Byrd, Rockville, MD (US); Brian Byrd, Russellville, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/924,206

(22) Filed: Mar. 17, 2018

(65) Prior Publication Data

US 2018/0206602 A1 Jul. 26, 2018

Related U.S. Application Data

(63) Continuation of application No. 15/287,703, filed on Oct. 6, 2016, now Pat. No. 9,918,524.

(60) Provisional application No. 62/237,859, filed on Oct. 6, 2015.

(51) Int. Cl.
*G07C 9/00* (2006.01)
*A44B 15/00* (2006.01)

(52) U.S. Cl.
CPC ..... *A44B 15/005* (2013.01); *G07C 9/00944* (2013.01); *G07C 2009/00984* (2013.01)

(58) Field of Classification Search
CPC ..... A44B 15/005; G07C 9/00944; G07C 2009/00984; G07C 2009/00952; G07C 2009/00992; A45C 11/328
USPC ..... 206/37.1–37.8; 70/456 R
See application file for complete search history.

(56) References Cited

U.S. PATENT DOCUMENTS 2,601,331 A * 6/1952 Segal ..... A45C 11/328 206/37.2
2,640,347 A * 6/1953 Majeski ..... A45C 11/321 362/116
4,628,717 A * 12/1986 Blum ..... A45C 11/321 30/162
5,220,319 A * 6/1993 Kendel ..... A44B 15/005 206/37.1
5,228,563 A * 7/1993 Stringham ..... A45C 11/328 206/37.2
5,232,086 A * 8/1993 Montanari ..... A45C 11/328 206/37.2
5,392,622 A * 2/1995 O'Donnell ..... A45C 11/321 206/37.4
5,460,022 A * 10/1995 Parsons ..... A45C 11/321 206/37.1
5,487,291 A * 1/1996 Voigt ..... A45C 11/32 206/37.2
5,495,942 A * 3/1996 Izhak ..... A45C 11/324 206/37.8
5,621,936 A * 4/1997 Penaligon ..... A44B 15/005 206/234

(Continued)

*Primary Examiner* — Chun Hoi Cheung
(74) *Attorney, Agent, or Firm* — Daniel Eisenberg, Esq.

(57) ABSTRACT

A multifunction key fob for retaining a plurality of keys and extending a selected key into a useable position. The multifunction key fob includes a housing with a motorized key tray inside the housing for selectively aligning a key with an ejection port in the housing. The key tray includes a plurality of key slots and a moveable key carriage in each key slot for moving a key up and down inside its respective slot. When a button on the surface of the housing is pressed, a key in a corresponding slot is extended.

17 Claims, 8 Drawing Sheets

(56) References Cited

U.S. PATENT DOCUMENTS

| | | | | |
|---|---|---|---|---|
| 6,079,845 | A * | 6/2000 | Kreider | A44B 15/005 362/116 |
| 6,237,756 | B1 * | 5/2001 | Caudle | A45C 11/328 206/37.2 |
| 6,371,286 | B1 * | 4/2002 | Montanari | A45C 11/328 206/37.3 |
| 7,937,977 | B2 * | 5/2011 | Booker | A45C 11/328 206/37.1 |
| 8,225,696 | B2 * | 7/2012 | Downes | A45C 11/328 29/402.06 |
| 8,341,989 | B1 * | 1/2013 | Hamblin | A45C 11/328 70/408 |
| 8,485,007 | B2 * | 7/2013 | Downes | A45C 11/328 70/395 |
| 9,918,524 | B2 * | 3/2018 | Byrd | A44B 15/005 |
| 2004/0085211 | A1 * | 5/2004 | Gotfried | B60R 25/104 340/576 |
| 2005/0179542 | A1 * | 8/2005 | Young | A44B 15/005 340/539.32 |
| 2007/0079639 | A1 * | 4/2007 | Hsu | A44B 15/005 70/456 R |
| 2010/0000885 | A1 * | 1/2010 | Downes | A45C 11/328 206/37.2 |
| 2010/0123549 | A1 * | 5/2010 | Lickfelt | G07C 9/00944 340/5.64 |
| 2015/0356393 | A1 * | 12/2015 | Daoura | G06Q 10/00 340/8.1 |
| 2017/0092030 | A1 * | 3/2017 | Badger, II | B60R 25/102 |

* cited by examiner

MULTIFUNCTION KEY FOB

CROSS REFERENCE TO RELATED APPLICATIONS

This application is a Continuation of U.S. application Ser. No. 15/287,703 entitled "MULTIFUNCTION KEY FOB" filed Oct. 6, 2016, which claims the benefit of U.S. Provisional Patent Application No. 62/237,859 entitled "ELECTROMECHNICAL MULTIFUNCTION KEY FOB" filed Oct. 6, 2015, both of which are incorporated herein by reference in their entirety.

FIELD OF THE INVENTION

The present invention relates to key holders and key dispensers.

BACKGROUND OF THE INVENTION

We have all experienced the frustration of carrying items in one hand (e.g. Grocery bags, boxes, etc.) and fumbling around for keys to enter our homes, offices, mailboxes, etc. All too often, we fiddle with our keys that are attached to our key ring to find the right key. Despite a great deal of inventive effort, this problem has not been solved to the full satisfaction of users.

Many known key holders are equipped with mechanical pop out mechanisms, which enable the key to be ejected out of the fob when a button is pushed. Although such key holders allow the user to store several keys inside the fob there is a problem with key selection functionality and accessibility, as the user has to search for the correct key to open a door.

SUMMARY OF THE INVENTION

A first preferred embodiment of the present invention comprises a multifunction key fob that extends a desired key from the fob. The fob may also include Wi-Fi, Bluetooth® and USB port, which enable a user to play music, issue voice commands, and configure the fob to interface with a user's automobile functions. The fob includes a memory capable of storing apps (i.e., software applications), which operates as an electronic non-volatile computer storage medium that can be erased and reprogrammed.

The multifunction key fob of the present invention includes a key tray with several key slots, a motor, a gear assembly and a lead screw for moving a key from a stowed position to a deployed position ready for use. Each key is seated in a moveable carriage inside a corresponding key slot. To select a desired key a user presses a labeled button on the keypad of the fob. Pressing the key transmits an electric signal to a motor to rotate a worm gear attached to the motor. The worm gear is operatively engaged with a spur gear and transmits rotational movement to the spur gear, which in turn is operatively engaged with a compound gear and transmits rotational movement to the compound gear, which is operatively engaged with a rack gear integral with the bottom end of the key tray, thereby transmitting lateral movement to the rack gear, which enables the key tray to move laterally along at least one transverse guide bar. In a preferred embodiment, the key tray moves along two opposite side transverse guide bars. The motorized tray stops moving when the selected key is aligned with an opening in the fob and the carriage couples with an anti-backlash nut. This position is known as the ready position. When the key is in the ready position, a motorized lead screw rotates, causing the anti-backlash nut to travel along the lead screw towards the opening in the fob until at least the shaft of the key extends from the fob opening. The selected key is thus extended from the key fob device.

According to an embodiment of the present invention, the key will stay in the extended position until the user selects another function button (e.g. Home Key Button, Work or Storage Key Button, Mail Box or Safe Key Button, Flashlight Button, Power on/off Button, Mobile, etc.), or presses the same button for the selected key again, causing the key to retract back into its slot (i.e., stowed position). The terms "loaded position" and "stowed position" shall be regarded as equivalent terms throughout this application. Other key fob functions may include: Phone Functions such as Communication, Push Button Emergency Dial, Answer/End Call Button, Volume Control Button; and Automobile Remote Functions such as Lock Button, Unlock Button, Alarm Button, Trunk Latch Button, and Press Button Ignition Start).

The fob may also be configured to download software apps from their smartphones, tablets, laptops, or home computers directly from an App Store, or Google play, etc. (e.g., Find my Smartkey apps, Automobile apps such as Mercedes Benz® app, BMW® app, Jeep® app, Audi® app and the like) and transfer the data to their multifunction key fob via Bluetooth®, Wi-Fi, or USB technology.

The present invention will now be described in detail with reference to the figures listed and described below.

DETAILED DESCRIPTION OF THE INVENTION

Figure 1:
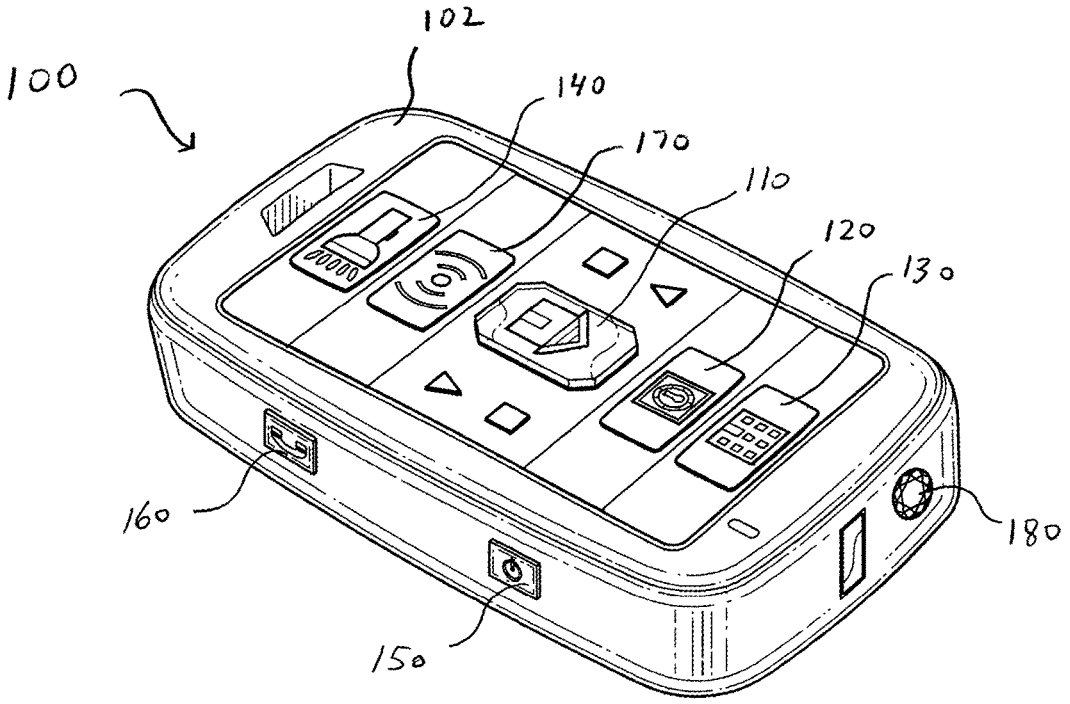
FIG. 1 is a perspective view of the key fob, according to an embodiment of the invention.

Embodiments of the present invention are generally directed towards a key dispensing device. Specifically, embodiments of the present invention are directed to a device for storing and dispensing a desired key. More specifically, the present invention is a key fob that holds a plurality of keys and extends a selected key into a useable position (i.e. ready to unlock a door) in response to user input.

According to an embodiment of the present invention, the key fob device may include one or more of a Central processing Unit (CPU), Random Access Memory (RAM), a storage medium (e.g., solid state drive, flash memory), an operating system (OS), one or more application software, one or more display elements and one or more input/output devices/means. One of ordinary skill in the art would appreciate that some of these components may be optional, such as the one or more display elements.

The fob device may be comprised of various components operably and/or communicatively connected with the other components of the apparatus, including, but not limited to a communications module, a communications bus, one or more storage mediums, a processor, memory, a voice recognition module, and a voice recorder. In alternate embodiments, the apparatus may have additional or fewer components. One of ordinary skill in the art would appreciate that the system may be operable with a number of optional components, and embodiments of the present invention are contemplated for use with any such optional component.

According to an embodiment of the present invention, the communications module of the device may be, for instance, any means for receiving, communicating and/or processing data, voice or video communications over one or more networks or to one or more peripheral devices attached to the apparatus. Appropriate communications modules may include, but are not limited to, a transceiver, wireless connections (e.g., WIFI modules, cellular modules), wired connections, cellular connections, data port connections, Bluetooth® connections, fiber optic connections, modems, network interface cards or any combination thereof. Moreover, the communications module may be configured to receive communications data from one or more components of the device and process the communications data into formats usable by other components of the system. One of ordinary skill in the art would appreciate that there are numerous communications modules that may be utilized with embodiments of the present invention, and embodiments of the present invention are contemplated for use with any communications module.

In a preferred embodiment of the present invention, the device will incorporate one or more interface ports for use and interaction with remote systems, communications devices, and external storage devices. Interface ports may include, but are not limited to universal serial bus (USB) ports, audio signal ports (e.g., RCA ports, 3.5 mm audio ports, ¼" audio ports), digital i/o ports, component input ports, HDMI ports, serial ports, parallel ports, proprietary data and/or audio ports, Ethernet ports, fiber-optic ports, general purpose input/output (GPIO) ports, charging ports, or any combination thereof. One of ordinary skill in the art would appreciate that there are numerous types of interface ports that could be utilized with embodiments of the present invention, and embodiments of the present invention are contemplated for use with any appropriate number and types of interface ports. In a preferred embodiment of the present invention, the interface port(s) provide a pathway for data to be transmitted to or received from external elements, such as a remote computing device.

In an exemplary embodiment according to the present invention, data may be provided to the device, stored by the device and provided by the device to remote computing devices or other systems across networks and systems including, but not limited to, in-vehicle networks (IVN), vehicle area networks (VANs), vehicular ad hoc networks (VANETs), mobile ad hoc networks (MANETs), controller area networks (CANs), media oriented systems transport (MOST®), local area networks (LANs) (e.g., office networks, home networks), or wide area networks (WANs) (e.g., the Internet), VOIP lines, analog land lines, fiber optic connections or any combination thereof.

In general, the functionality and methods provided by the device are available whether connected to a specific network or not. According to an embodiment of the present invention, some of the applications of the present invention may not be accessible when not connected to a network, however the device may be able to process data offline that can be utilized when the device is not connected to a network, or when the device is later connected to a network.

The multifunction key fob of the present invention allows a user to have their keys, phone, music and automobile remote functions all in one device. According to one embodiment, the key fob includes a housing and a moveable key tray mounted on a pair of opposite side transverse guide bars inside the housing. Although a pair of transverse guide bars is described herein, a different number of guide bars may be used such as a single guide bar, or more than two guide bars without departing from the invention.

The key tray includes one or more key slots for storing keys, such as a home key, work key, mail box key, or the like. Each key slot includes a carriage mounted therein. An individual key is mounted on a carriage which is able to move from one end of its corresponding key slot to an opposite end thereof.

A tray motor is mounted inside the housing and is operably connected to the moveable tray, causing it to move along the pair of opposite side transverse guide bars. Specifically, the tray motor includes an output shaft connected to a worm gear 230. The worm gear is operably engaged with a compound gear 260, which includes a smaller gear mounted on a larger gear. The worm gear engages the larger gear of the compound gear, while the smaller gear engages with teeth disposed along the bottom of the tray, such that rotation of the compound gear causes the tray to move laterally along the transverse guide bars.

The device also includes a motorized rotatable lead screw mounted inside the housing. Specifically, the device includes a second motor with an output shaft connected to a lead screw. A threaded anti-backlash nut is mounted on the motorized lead screw, such that when the motorized lead screw rotates the anti-backlash nut travels along the screw. The anti-backsplash nut is also connected to a guide rod 420 that guides the anti-backsplash nut along the screw.

The anti-backsplash nut is configured to couple to a carriage when the carriage comes into contact with the anti-backsplash nut. Once coupled together, the motorized screw is automatically activated causing the screw to rotate in a direction that causes the anti-backsplash nut with attached carriage to travel along the screw towards an ejection port in the housing. A key seated in the carriage is positioned in the carriage so as to extend through the ejection port as the carriage reaches the end of the lead screw 510, at which point the motor receives a signal to cease rotating the lead screw. The extended key is thus stopped in a position in which it can be used to unlock a door. Rotating the lead screw in an opposite direction causes the key to be retracted back into the housing and into a stowed position inside the housing, at which point the motor again receives a signal to stop rotating the lead screw.

The device includes a plurality of key selector buttons on its surface, including a button corresponding to each of the keys stored inside the device. Depressing one of the key selector buttons activates the tray motor which moves they key tray laterally along the pair of transverse guide bars until the slot corresponding to the depressed selector button is aligned with an opening in the housing and the key carriage is operably coupled with the anti-backlash nut. This coupling causes the motorized lead screw to be activated and rotate. Rotation of the lead screw in one direction causes the anti-backlash nut with coupled key carriage to travel along the lead screw towards the ejection port in the housing. The key seated in the carriage extends through the ejection port as the carriage reaches the end of the lead screw, and the carriage stops moving (i.e., rotation of the lead screw ceases) when the key is fully extended into a useable position.

Selecting the same button again, or a different button on the device, sends a signal to the motor to rotate the lead screw in the opposite direction, thereby causing the key to retract back into the housing until the key is back in a stowed position at the bottom of the key slot, at which point the motor ceases to rotate the lead screw.

Turning to the Figures, a key fob device 100 is shown in FIG. 1. The key fob includes a housing 102 with a plurality of buttons, including one or more key dispensing buttons, such as a house key button 110, mail box key button 120, office key button 130, or others, each key dispensing button corresponding to a specific key tray slot that holds the selected type of key. The device may also include additional buttons that activate additional functions of the key fob. These include a flashlight button 140 that activates/deactivates a flashlight 180, an alarm button 170 that activates/deactivates an alarm, such as an auditory alarm or transmits an alarm signal to a monitoring service or device, and a power on/off button 150. Other buttons may include volume control buttons 630 for adjusting the volume of a Bluetooth® enabled device, such as a car radio. Another button could include a mobile phone button 160 that initiates a phone call to one or more preprogrammed recipients over a cellular network, or using voice over internet protocol (VOIP) over the Internet.

The key fob device may also include a plurality of ports, such as a universal serial bus (USB) port, charging port, and a general purpose data port. In addition, the key fob device may include a microphone for receiving voice commands or recording audio messages, a speaker phone feature, a battery power indicator light, an infrared transmitter, and a breathalyzer interface.

Figure 2:
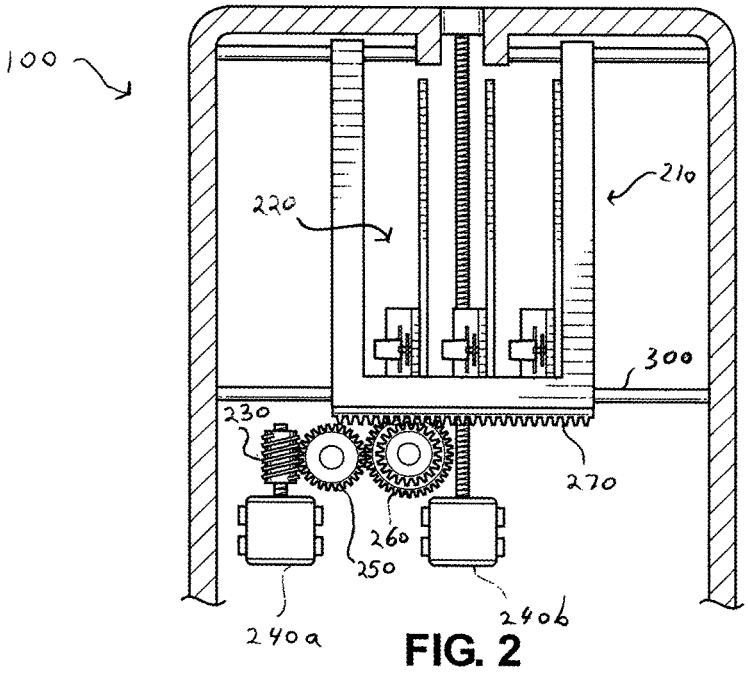
FIG. 2 is a side sectional view of the key fob of FIG. 1, according to an embodiment of the invention.

Turning to FIG. 2, a partial internal cross-sectional view of the key fob device is shown. Motor 240*a* moves the key tray 210 along the transverse guide bars 300. Specifically, motor 240*a* includes an output shaft with a worm gear 230 mounted thereon. However, one of ordinary skill in the art will appreciate that other types of gears may be used in place of a worm gear. The worm gear 230 operably engages a spur gear 250 which engages the larger gear of a compound gear 260. The smaller gear of compound gear 260 engages a row of teeth 270 disposed along the bottom of the key tray. As can be seen in FIG. 2, rotation of the worm gear causes the spur gear to rotate and transmit power to the compound gear which causes the tray to move along the transverse guide bars 300.

Figure 3:
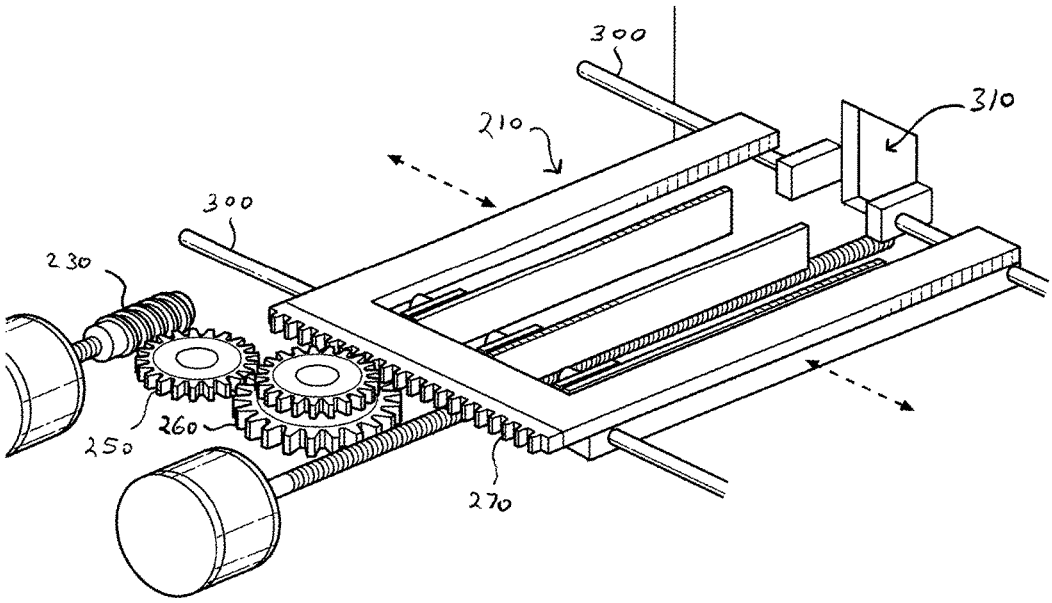
FIG. 3 is a perspective view of the internal drive mechanism of the key fob of FIG. 1, according to an embodiment of the invention.

FIG. 3 provides a perspective view of the internal mechanism illustrated in FIG. 2. In addition, ejection port 310 is shown. Selecting a key dispensing button causes the key tray to move into position until the key slot for the selected key is aligned with ejection port 310. A sensor in the key slot may signal the motor 240*a* to stop when the key slot is in position to deploy the selected key. Once motor 240*a* stops running and the key tray stops, the key carriage 650 on which the selected key is mounted engages with the anti-backlash nut 500. One or both of the motor being deactivated and the tray stopping can signal for the key carriage 650 to couple with the anti-backlash nut 500. One of ordinary skill in the art will appreciate that the coupling mechanism between the anti-backlash nut and the key carriage may take any number of forms, including magnetic coupling, mechanical coupling, electromechanical coupling, or other forms of coupling, but is preferably an electromechanical coupling that responds to an electrical signal to engage or disengage the key carriage 650 from the anti-backlash nut 500.

Figure 4:
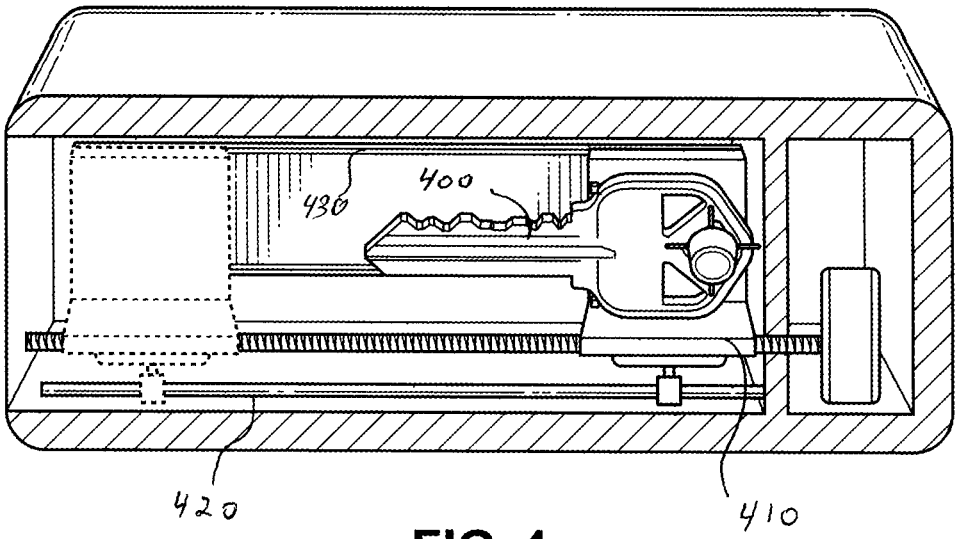
FIG. 4 is a side sectional view of the key fob of FIG. 1, according to an embodiment of the invention.
Figure 5:
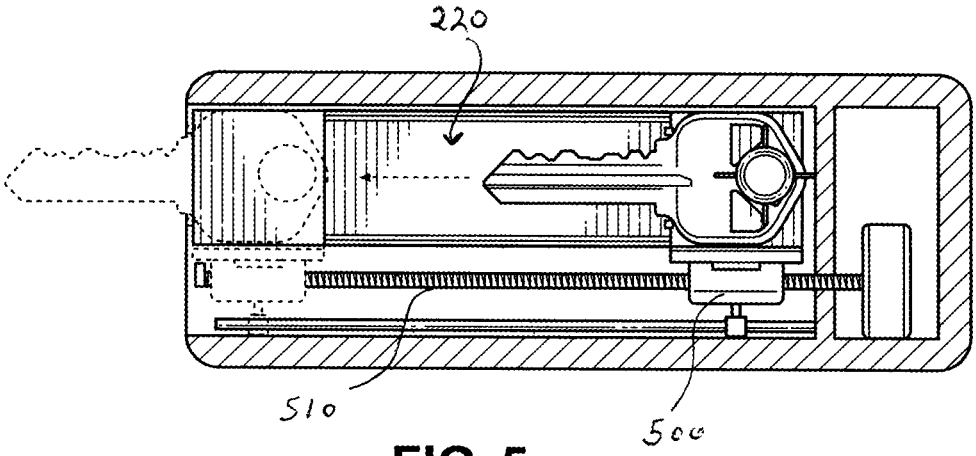
FIG. 5 is a side sectional view of the key fob of FIG. 1 showing how the key moves from a loaded position to an extended position, according to an embodiment of the invention.

FIGS. 4-5 are partial sectional views of the key fob device showing a key mounted to a carriage 650 in its respective slot and how the key is deployed by way of the key deployment mechanism described herein. As previously explained, motor 240*a* moves the key tray into position so that the carriage 650 holding the selected key couples with the anti-backlash nut 410. Motor 240*b* is then activated sending key 400 to the opposite end of the slot, such that the key extends through the ejection port 310. Deployment of the selected key is accomplished by rotating the lead screw until the key reaches the opposite end of the slot and extends through the ejection port, into a useable position outside of the housing. A first sensor or trigger on the guide rod 420, on the carriage track 430, or in the slot may be configured to deactivate motor 240*b* and prevents the carriage from advancing beyond a certain point in the slot. In any case, the carriage is stopped when the key reaches a predetermined position and can be used to open a door.

In a similar manner, the selected key is retracted back into the housing 102 and into a stowed position at the base of the slot. Specifically, when a user selects the same button that deployed the key, or another button on the device, a signal is transmitted to the motor to rotate the lead screw in a reverse direction. For example, a user could select a dedicated key retraction button that causes the deployed key to retract back into the housing. The term "button" is meant to cover physical buttons as well as touch screen button objects that appear on a display screen.

A trigger or sensor on the guide bar 420, on the carriage track 430, or in the slot, can be used to deactivate the motor 240*b* when the carriage 650 reaches the base of the slot (i.e. the stowed position). Once the carriage is back in a stowed position the carriage decouples from the anti-backlash nut 500.

Figure 6A:
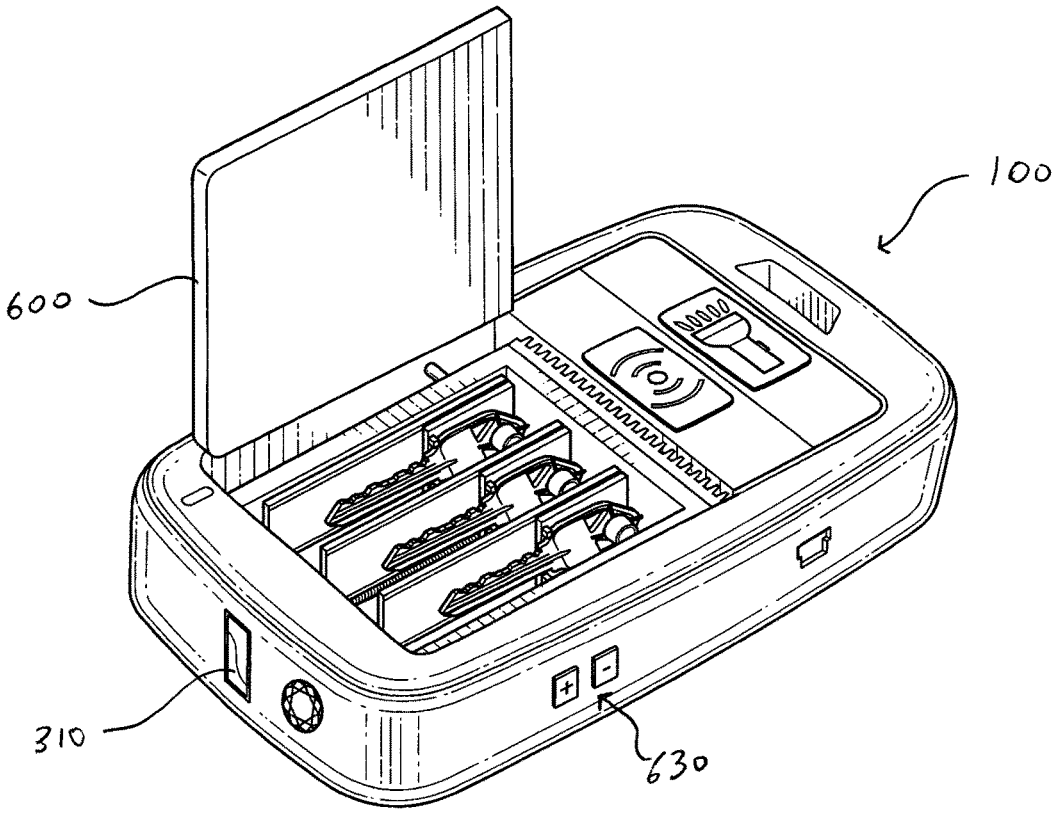
FIG. 6A is a perspective view of the key fob of FIG. 1 with an open face panel showing the keys loaded in their respective key ports, according to an embodiment of the invention.
Figure 6B:
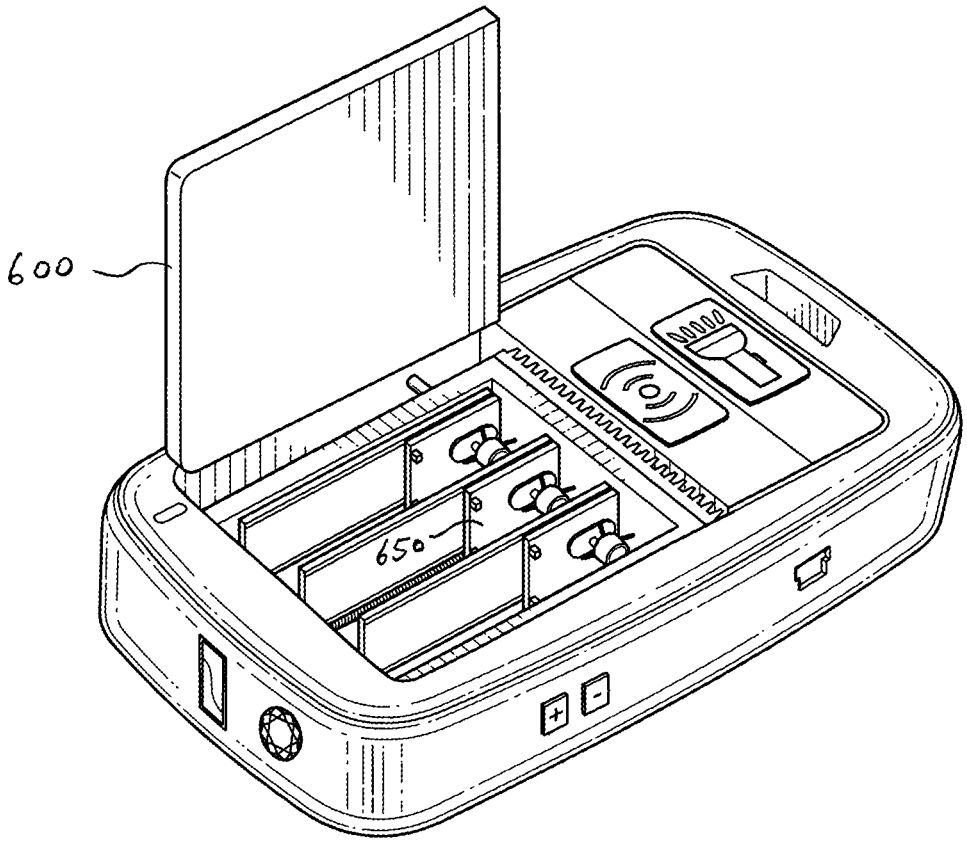
FIG. 6B is a perspective view of the key fob of FIG. 1 with an open face panel showing empty key ports, according to an embodiment of the invention.
Figure 6C:
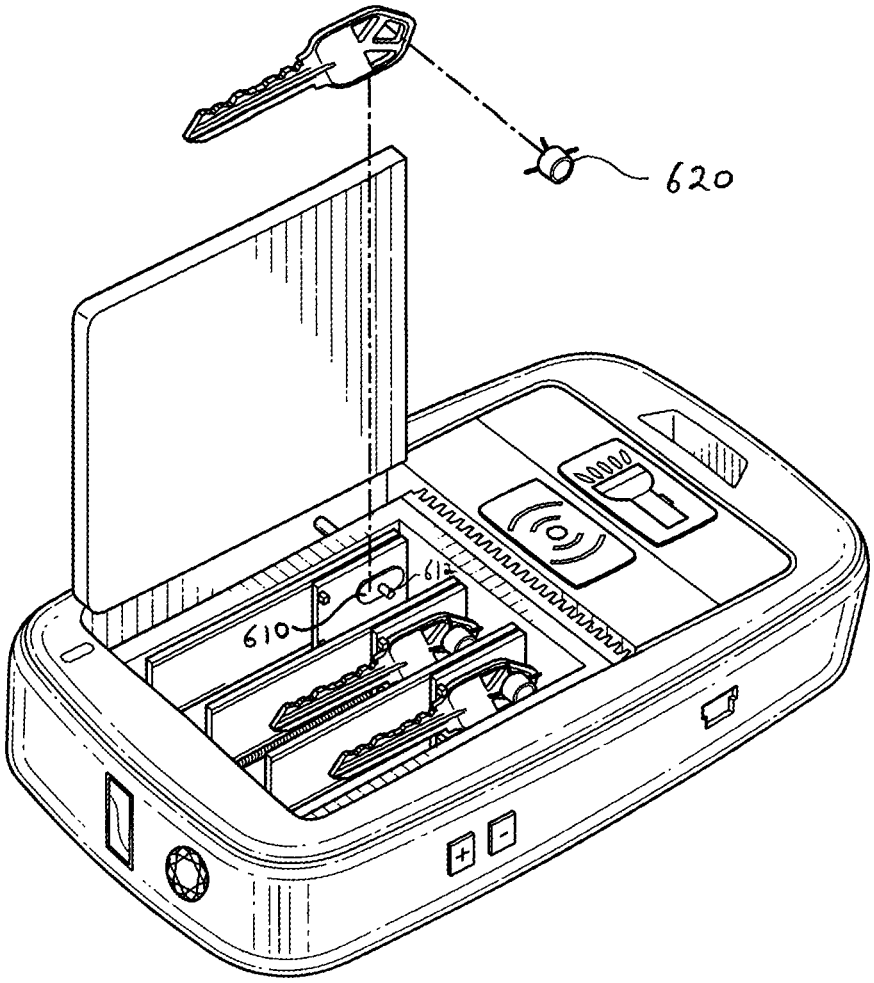
FIG. 6C is a perspective view of the key fob of FIG. 1, with an open face panel showing how each key is mounted in its respective key port, according to an embodiment of the invention.

FIGS. 6A-6C shows an embodiment of the key fob device that has a cover 600 that may be opened and/or removed. When the cover 600 is opened a user can view and access the key tray. Although the figures depict three key slots with three keys, a person of ordinary skill in the art will appreciate that the key tray can include fewer or more key slots and keys.

FIG. 6B shows the key fob device with an empty key tray. In this view one can see key carriage 650 that moves along track 430. The carriage 650 includes an oval shaped platform 610 with a post extending therefrom. A key can thus be mounted on the post as shown in FIG. 6C. A nut or cap is then threaded or affixed to the post to secure the key in place. One of ordinary skill in the art will recognize that a key can be attached to the carriage 650 in other ways such as clips, snaps, insertion into a slot or groove, or other means of attachment known in the art. In addition, the cap may be configured to form a tight fit with the post, such as by inserting the post into a tight opening in the cap. If the post is threaded, the cap would include a threaded opening for receiving the threaded post. Furthermore, the cap may include a textured surface or tines to assist in twisting the cap on and off the post.

Figure 7:
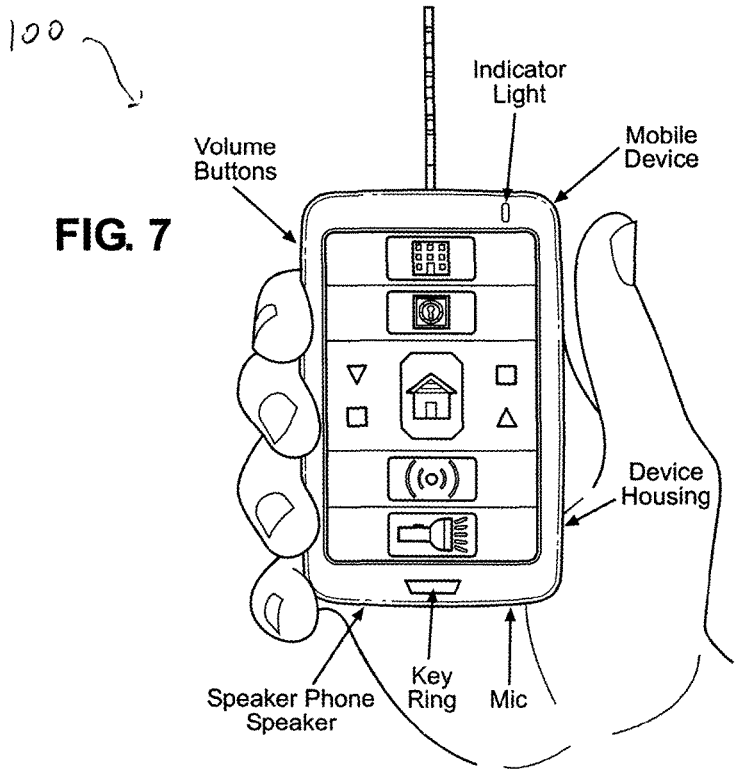
FIG. 7 is an environmental perspective view of the key of FIG. 1.
Figure 8:
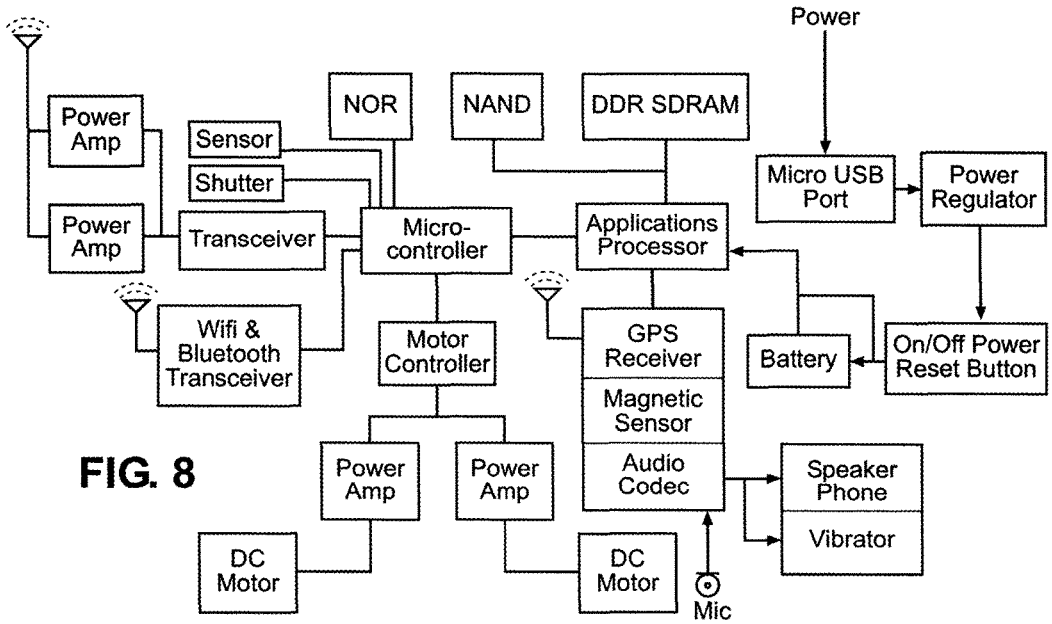
FIG. 8 is a schematic view of key fob system components, according to an embodiment of the invention.

FIG. 7 shows an exemplary embodiment of the key fob device with a selected key in a deployed position. FIG. 8 shows a schematic of key fob components according to an embodiment of the invention.

Figure 9:
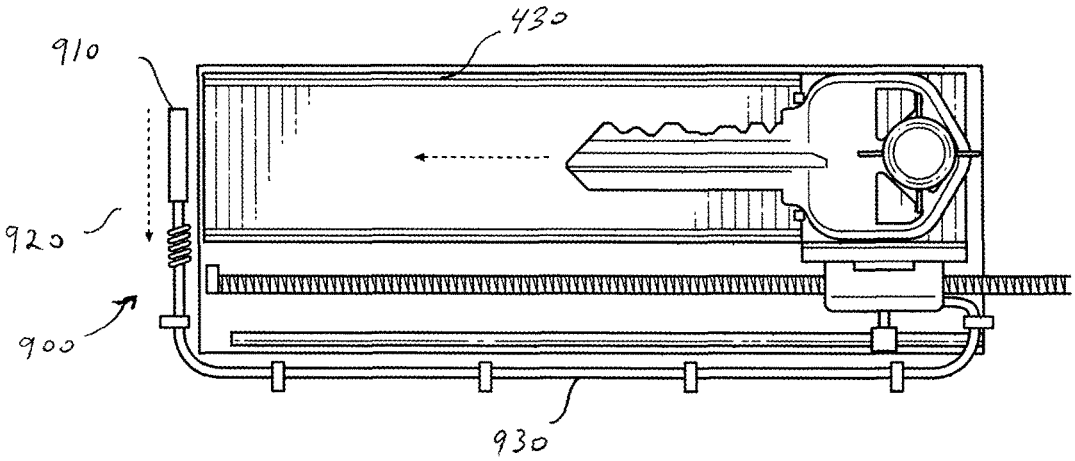
FIG. 9 is a side sectional view of the key fob of FIG. 1, showing the exit port shutter mechanism, according to an embodiment of the invention.

FIG. 9 shows a partial sectional view of the key fob device in accordance with another embodiment of the invention. According to the embodiment of FIG. 9 a shutter mechanism 900 opens and closes ejection port 310 by extending and retracting a shutter 910 that covers the ejection port. The shutter 910 automatically opens when the key carriage 650 moves towards the ejection port. Specifically, a cable 930 attached to the shutter 910 at one end, and to the anti-backlash nut at the other end, pulls the shutter in the direction indicated by arrow 920. As the anti-backlash nut moves up along the lead screw, toward the ejection port, the cable is pulled thereby opening the shutter. When the anti-backlash nut moves backwards along the lead screw, the cable is released thus closing the shutter. A person of ordinary skill in the art will recognize that there are other shutter mechanisms that can be employed with the instant key fob device, such as a simple leaf shutter, a diaphragm shutter mechanism as described in U.S. Pat. No. 3,366,024 entitled "Diaphragm Actuating Mechanism", incorporated herein by reference in its entirety, or an electronic shutter.

While the foregoing drawings and description set forth functional aspects of the disclosed systems, no particular arrangement of software for implementing these functional aspects should be inferred from these descriptions unless explicitly stated or otherwise clear from the context.

According to another embodiment, the key fob device is programmable and may include one or more microprocessors, microcontrollers, embedded microcontrollers, programmable digital signal processors, programmable devices, programmable gate arrays, programmable array logic, memory devices, application specific integrated circuits, or the like, which can be suitably employed or configured to process computer program instructions, execute computer logic, store computer data, and so on. Throughout this disclosure and elsewhere the key fob device can include any and all suitable combinations of these components.

It will be understood that the key fob can include a computer-readable storage medium and that this medium may be internal or external, removable and replaceable, or fixed. It will also be understood that the key fob can include a Basic Input/Output System (BIOS), firmware, an operating system, a database, or the like that can include, interface with, or support the software and hardware described herein.

Embodiments of the system as described herein are not limited to applications involving conventional computer programs or programmable devices that run them. It is contemplated, for example, that embodiments of the invention as claimed herein could include an optical computer, quantum computer, analog computer, or the like.

Regardless of the type of computer program or computer involved, a computer program can be loaded onto the key fob device to produce a particular device that can perform any and all of the depicted functions. This particular device provides a means for carrying out any and all of the depicted functions.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Computer program instructions can be stored in a computer-readable memory capable of directing a computer or other programmable data processing device to function in a particular manner. The instructions stored in the computer-readable memory constitute an article of manufacture including computer-readable instructions for implementing any and all of the depicted functions.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

It will be appreciated that computer program instructions may include computer executable code. A variety of languages for expressing computer program instructions are possible, including without limitation C, C++, Java, JavaScript, assembly language, Lisp, HTML, and so on. Such languages may include assembly languages, hardware description languages, database programming languages, functional programming languages, imperative programming languages, and so on. In some embodiments, computer program instructions can be stored, compiled, or interpreted to run on a computer, a programmable data processing device, a heterogeneous combination of processors or processor architectures, and so on.

In some embodiments, a computer enables execution of computer program instructions including multiple programs or threads. The multiple programs or threads may be processed more or less simultaneously to enhance utilization of the processor and to facilitate substantially simultaneous functions. By way of implementation, any and all methods, program codes, program instructions, and the like described herein may be implemented in one or more thread. The thread can spawn other threads, which can themselves have assigned priorities associated with them. In some embodiments, a computer can process these threads based on priority or any other order based on instructions provided in the program code.

Unless explicitly stated or otherwise clear from the context, the verbs "execute" and "process" are used interchangeably to indicate execute, process, interpret, compile, assemble, link, load, any and all combinations of the foregoing, or the like. Therefore, embodiments that execute or process computer program instructions, computer-executable code, or the like can suitably act upon the instructions or code in any and all of the ways just described.

The functions and operations presented herein are not inherently related to any particular computer or other device. Various general-purpose systems may also be used with programs in accordance with the teachings herein, or it may prove convenient to construct more specialized apparatus to perform the required method steps. The required structure for a variety of these systems will be apparent to those of skill in the art, along with equivalent variations. In addition, embodiments of the invention are not described with reference to any particular programming language. It is appreciated that a variety of programming languages may be used to implement the present teachings as described herein, and any references to specific languages are provided for disclosure of enablement and best mode of embodiments of the invention. Embodiments of the invention are well suited to a wide variety of computer network systems over numerous topologies. Within this field, the configuration and management of large networks include storage devices and computers that are communicatively coupled to dissimilar computers and storage devices over a network, such as the Internet.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

Multifunction Key Fob General Functions

According to an embodiment of the present invention, the multifunction key fob includes a key tray with a plurality of key slots, motors, gears and a motorized lead screw configured to move a key into an extended position. A key is seated in a moveable carriage inside a corresponding key slot.

To select a desired key a user simply presses a labeled key or button on the keypad of the fob. In one embodiment, pressing the key sends an electric signal to a motor to rotate a worm gear attached to the motor. The worm gear is operably engaged with a spur gear and transmits rotational movement to the spur gear, which in turn is operably engaged with a compound gear and transmits rotational movement to the compound gear, which is operably engaged with a row of teeth integral with the bottom end of the key tray, thereby transmitting lateral movement to the rack gear, which enables the key tray to move laterally along opposite side transverse guide bars.

In a preferred embodiment, each opposite side of the key tray is connected to a transverse guide bar, such that the key tray moves laterally along the opposite side transverse guide bars. The motorized tray stops moving when the selected key is aligned with an ejection port in the fob. This position is known as the "ready position." When the key is in the ready position, the key carriage of the selected key couples to an anti-backlash nut a motorized lead screw rotates, causing the anti-backlash nut and attached carriage to travel along the lead screw towards the ejection port until at least the shaft of the key extends from the fob opening. The selected key is thus extended from the key fob device. In one embodiment, a sensor in the anti-backlash nut, the carriage, or in the tray detects when the carriage holding the selected key is in the read position, so that the anti-backlash nut can engage with the carriage.

The above-described mechanism for deploying a key into a useable position is one embodiment and the invention is not limited to this particular embodiment. For example, the order and arrangement of motors and gears may be different. Furthermore, there may be a different number of motors and gears than what is described above. One of ordinary skill in the art will appreciate that the gears and motors can be arranged in any manner that allows the key tray to move laterally from left to right or right to left along the transverse guide bars.

According to another embodiment of the present invention, the key will stay in the extended position until the user selects another function button (e.g. Home Key Button, Work or Storage Key Button, Mail Box or Safe Key Button, Flashlight Button, Power on/off Button, Mobile, etc.), or presses the same button for the selected key again, causing the key to retract back into its slot. Other key fob functions may include: Phone Functions such as Communication, Push Button Emergency Dial, Answer/End Call Button, Volume Control Button; and Automobile Remote Functions such as Lock Button, Unlock Button, Alarm Button, Trunk Latch Button, Press Button Start).

According to the embodiment illustrated in FIGS. 6A-6C, a magnetic screw and screw-on cap may be used to securely mount each key in its respective key slot. The key is mounted over a screw and sits on an oval shaped key adjuster base plate from which the screw projects. The oval shaped plate, in turn, is affixed to a rectangular plate in the key slot. The screw-on cap is rotatably attached to the screw, such that the key is snugly secured between the plate and the screw-on cap. The screw-on cap may further comprise a plurality of projections to assist in twisting the screw.

In an alternative embodiment, a key is mounted on a pin projecting from the key adjuster base plate, and instead of a screw-on cap, a pressure fitted cap is fitted onto the pin to secure the key in place. One of ordinary skill in the art will appreciate that there are many other ways to mount a key in a key slot, such as with clips, magnets, hook and loop attachment, etc.

According to an embodiment of the invention, a battery power indicator light may be disposed on a front face of the key fob device as shown in FIG. 7. The indicator light may glow blue when battery power remains above a threshold value, and glow red when battery power is below the threshold value. One of ordinary skill in the art will appreciate that other means of signaling a low battery may be used, such as different colored lights, a flashing light, a low-battery tone, an icon displayed on a display screen, or another means known in the art.

According to the embodiment shown in FIGS. 6B and 6C, key adjuster plates may be used to position keys of different sizes in their respective slot, so that they properly extend through the ejection port when selected. The key adjuster plates move left to right.

According to the embodiment of the invention illustrated in FIG. 9, a shutter system may be employed to cover the ejection port when the keys are in their stowed position. The shutter system automatically opens the ejection port when a key is selected and moves toward the ejection port. More specifically, when the anti-backlash nut moves along the lead screw, toward the key opening, a first portion of a flexible cable is pulled, opening the shutter. When the anti-backlash nut moves backwards on the lead screw, a second portion of the flexible cable is pulled, closing the shutter.

Automobile Remote Functions

In this embodiment, the multifunction key fob is operative as a mobile handheld wireless automobile remote. The device will run operating system software, such Windows® or Mac OS®, and is capable of running third party software in the form of "apps" (i.e. software applications) as well. These apps may be necessary to configure the automobile remote functions on the multifunction key fob. By simply downloading the personal automobile apps (e.g. Mercedes Benz® app, BMW® app, Nissan® app, and the like) by way of USB, Bluetooth®, or Wi-Fi to the key fob, a user can control key components such as door locks, the trunk latch, alarm system, and push button start.

Cell Phone Functions

In this embodiment, the multifunction key fob is configured to function as a mobile handheld wireless communications device. It will typically comprise components and/or functionality that includes at least one wireless transceiver (often at least one of these wireless transceivers will be a standard cellular phone GSM, TDMA, 3G, 4G, or CDMA transceiver). To enable voice communications, the device will typically have at least one microphone and at least one sound output device. This sound output device may be one or more speakers, with controllable volume on the multifunction key fob device when the user is communicating, or listening to music via Bluetooth® through their Smartphone.

Power Options

In one embodiment, the invention is a multifunction key fob that extends keys and also includes a portable wireless communications device, such as a Smartphone. The device may be powered by a variety of methods, including lithium-ion rechargeable batteries, conventional batteries, fuel cells, and solar cells, and may additionally have an ability to power itself or charge its batteries by harvesting the energy from radio signals or may incorporate a body temperature heat sensor which powers the device on and off.

Additional Features

Additional embodiments of the key fob device may include one or more of the following features.

Breathalyzer: A key fob is a convenient place for collecting data about a person's blood alcohol content (BAC) levels. On the back of the key fob is a blowhole for collecting data, and inside the key fob is an electro-chemical fuel cell sensor for analyzing data. This allows key fob device to provide a comprehensive picture of your (BAC) levels. By using the key fob device one has the ability to help prevent accidents and potentially save lives.

Key Finder: The key fob device may also include a homing beacon or GPS tracking system that helps locate the device if lost or misplaced. The device can be located, for example, by using a "ping my key" function from a software application configured to locate the key fob device. The software application can be used on any standalone or mobile computing device.

Key ring: The key fob device may feature a push button key ring release that allows a user to quickly interchange any set of keys as needed. A user can thus change any sets of keys on the fly.

Emergency SOS: The key fob device may also be configured to transmit an Emergency SOS distress call to local emergency services. The device can further be configured to send an Emergency SOS message to programmed emergency contacts.

Activity Tracker: The key fob device may also be configured to provide real-time health statistics such as: calories burned, carbs consumed, steps traversed, miles traveled, distance, floors climbed, and time engaged in physical activity.

Key Pay: The key fob device may also be configured to transmit payment information at a payment terminal. A user can simply waive the key fob device in close proximity to a card reader, while placing their finger on a fingerprint ID sensor on the device. A confirmation such as a beep sound indicates that the transaction is complete.

What is claimed is:

1. A multifunction key fob, comprising:

a housing defining an opening through which a key is deployed;

a moveable key tray contained within said housing and comprising a plurality of key slots;

a tray motor mounted in said housing and operably connected to said moveable tray; and a plurality of key selector buttons on a surface of said housing, said key selector buttons corresponding to each of said key slots, wherein selecting one of said key selector buttons causes the key in the corresponding slot to be deployed, through said opening, to a useable position.

2. A The multifunction key fob of claim 1, wherein said moveable tray is mounted on at least one transverse guide bar in said housing.

3. A The multifunction key fob of claim 2, further comprising:

a moveable key carriage mounted in each of said key slots, wherein said carriage is configured to:

retain a key, and move from one end of its corresponding key slot to an opposite end thereof.

4. A The multifunction key fob of claim 3, further comprising:

a motorized rotatable screw mounted in said housing;

an anti-backlash nut mounted on said motorized screw;

a tray motor mounted in said housing and operably connected to said moveable key tray, wherein selecting one of said key selector buttons actuates said tray motor which moves said key tray laterally along said at least one transverse guide bar, until the slot corresponding to the selected button is aligned with the opening in said housing and said key carriage is operably engaged with said anti-backlash nut, wherein said motorized screw is actuated upon coupling of said key carriage with said anti-backlash nut causing said screw to rotate, thus causing said anti-backlash nut to travel along said lead screw towards the opening in said housing, wherein a key seated in said key carriage extends though said opening in said housing wher said key carriage reaches an end of said of said lead screw, such that said key is in a useable position.

5. A The multifunction key fob of claim 1, further comprising a flashlight integrated into said housing and a button on said housing that activates or deactivates said flashlight.

6. A The multifunction key fob of claim 1, further comprising an alarm component integrated into said housing and a button on said housing that activates or deactivates said alarm.

7. A The multifunction key fob of claim 1, wherein said housing includes a plurality of ports comprising a universal serial bus (USB) port, a charging port, and a general purpose data port.

8. A The multifunction key fob of claim 1, further comprising a microphone integrated into said housing.

9. A The multifunction key fob of claim 1, further comprising a battery power indicator light integrated into said housing.

10. A The multifunction key fob of claim 1, further comprising an infrared transmitte integrated into said housing.

11. A The multifunction key fob of claim 1, further comprising a breathalyzer interface integrated into said housing.

12. A The multifunction key fob of claim 1, wherein said housing includes a removeable cover that provides access to the key tray.

13. A The multifunction key fob of claim 1, further comprising a shutter mechanism configured to uncover said key opening in response to deployment of a key.

14. A The multifunction key fob of claim 1, wherein a deployed key remains in a deployed position until a user selects another button on said key fob.

15. A The multifunction key fob of claim 1, further comprising a transceiver device integrated into said housing, wherein said transceiver is configured to transmit and receive radio signals for communications.

16. A The multifunction key fob of claim 15, further comprising a speaker phone audio component integrated into said housing.

17. A The multifunction key fob of claim 1, further comprising a microcomputer in said housing, wherein said microcomputer comprises a processor, memory, and a communications means for downloading, storing, and running one or more software applications.

* * * * *